US005745540A

United States Patent [19]

Okada et al.

[11] Patent Number: 5,745,540

[45] Date of Patent: Apr. 28, 1998

[54] PORTABLE BILL COUNTER DETECTING FORGERIES

[75] Inventors: Hidemi Okada, Tokyo; Susumu Ozawa, Niiza, both of Japan

[73] Assignee: Mu Co., Ltd., Japan

[21] Appl. No.: 513,138

[22] Filed: Aug. 9, 1995

[30] Foreign Application Priority Data

| | | | |
|---|---|---|---|
| Aug. 10, 1994 | [JP] | Japan | 6-188472 |
| Nov. 28, 1994 | [JP] | Japan | 6-293216 |

[51] Int. Cl.[6] ..... G06M 7/00

[52] U.S. Cl. ..... 377/8

[58] Field of Search ..... 377/8

[56] References Cited

U.S. PATENT DOCUMENTS

| | | | |
|---|---|---|---|
| 4,566,109 | 1/1986 | Sanuga | 377/2 |
| 4,677,682 | 6/1987 | Miyagawa et al. | 377/8 |
| 4,700,368 | 10/1987 | Munn et al. | 377/8 |
| 4,817,804 | 4/1989 | Kawano et al. | 377/8 |
| 4,830,742 | 5/1989 | Takesako | 377/8 |
| 5,612,984 | 3/1997 | Fuller et al. | 377/8 |

FOREIGN PATENT DOCUMENTS

| | | |
|---|---|---|
| 2073718 | 10/1981 | United Kingdom . |
| 2260206 | 4/1993 | United Kingdom . |
| 2262176 | 6/1993 | United Kingdom . |
| WO9325980 | 12/1993 | WIPO . |

*Primary Examiner*—Margaret Rose Wambach
*Attorney, Agent, or Firm*—Brown, Martin, Haller & McClain, LLP

[57] ABSTRACT

A bill counter comprises a case body formed to be a size which can be carried; a display section provided on the surface of the case body; an insertion port provided on one side of the case body which is capable of being expanded/contracted; a taking-out port provided on the other side of the case body; a first feeding-out device which is provided on the insertion port side within the case body and feeds out bills in a bundle inserted to the insertion port by a few sheets; a second feeding-out device which is provided on the taking-out port side within the case body and feeds out bills one by one fed out by the first feeding-out device; a driving section which drives simultaneously the first and the second feeding-out devices; an identifying sensor which identifies bills going toward the taking-out port; and a control section which outputs a signal displaying the number of sheets by unit of each bill and the total amount at least to said display section based on the signal from the identifying sensor and a signal which stops the operation of the driving section when a forged bill is detected.

10 Claims, 18 Drawing Sheets

PORTABLE BILL COUNTER DETECTING FORGERIES

BACKGROUND OF THE INVENTION

1. Field of the Invention

The present invention relates to a bill counter which is not restricted by the place where it is used, and can display the number of sheets by unit of bills and the total amounts thereof.

2. Description of the Prior Art

In banks and the like where bills are handled in large amounts, the number of sheets of bills has been conventionally counted by setting a bundle of bills which are sorted separately by unit of bills, such as 1,000-yen bill, 5,000-yen bill and 10,000-yen bill.

Since a conventional bill counter is large-sized and fixed-type, a space for installation is required, and there are such problems that it cannot be carried and cannot be used when 1,000-yen bills, 5,000-yen bills and 10,000-yen bills are mixed at random.

SUMMARY OF THE INVENTION

The object of the present invention, therefore, is to provide a bill counter which is not restricted by the place where it is used and can display the number of sheets by unit of bills and the total amounts thereof, while having a function as a device for finding forged bills.

In order to achieve the above-mentioned object, the first embodiment of the present invention comprises a case body formed to be a size which can be held by a single hand: a display section provided on the surface of the case body; an insertion port provided on one side of the case body which is capable of being expanded/contracted; a taking-out port provided on the other side of the case body; a first feeding-out device which is provided on the insertion port side within the case body and feeds out bills in a bundle inserted to the insertion port by a few sheets; a second feeding-out device which is provided on the taking-out port side within the case body and feeds out bills one by one fed by the first feeding-out device; a driving section which drives simultaneously the first and the second feeding-out devices; an identifying sensor which identifies bills fed out by said second feeding-out device; and a control section which outputs a signal displaying the number of sheets by unit of each bill and the total amount at least to said display section based on the signal from said identifying sensor and a signal which stops the operation of the driving section when a forged bill is detected.

The first feeding-out device includes a rotating body of a roller type or a belt type whose outer peripheral face is formed on the friction face, and a pressing body which always presses the bundle of bills inserted to the insertion port against the rotating body.

Furthermore, the second feeding-out device includes a pair of rotation rollers on right and left whose outer peripheral face is formed on the friction face, and a control member which is capable of going forward/backward, holds the tip end of the bills other than the first bill overlapping with each other against the rotation roller and controls its feeding.

The second embodiment comprises a display section provided on the surface of the case body formed to be a size which can be carried; a setting port which is provided on one side of the case body and sets the bills; a taking-out port provided on the other side of the case body; a separation/feeding-out device which separates and feeds the bills supplied from the setting port one by one; a taking-out device which takes out the bills from the taking-out port to the outside; a driving section which drives simultaneously the separation/feeding-out device and the taking-out device; an identifying sensor which identifies bills fed out by said separation/feeding-out device; and a control section which outputs a signal displaying the number of sheets by unit of each bill and the total amount at least to said display section based on the signal from the identifying sensor, and a signal which stops the operation of the driving section when a forged bill is detected, wherein the speed for taking out the bills toward outside by the taking-out device is made faster than the feeding speed of the bills which are fed out by said separation/feeding-out device.

The separation/feeding-out device comprises a first rollers which are pivotally attached rotatably on right and left of a roller shaft and are composed of geared double rubber rollers having a peripheral groove in the central portion and of geared roller faces with a shape projecting partly from a notch window of a guide plate; a holding rollers which are firmly adhered to an eccentric shaft and faces into the peripheral grooves of the first right and left rollers so as to hold the surface of a bill W down into the peripheral groove; and a second rollers which are energized downward so as to be brought into contact with the geared roller faces inside of the first rollers, as well as being supported horizontally movably by a supporting arm extended from the eccentric shaft of the holding rollers.

The identifying sensor comprises a combination of a photosensor and a magnetic sensor, and the position to attach an encoder which detects the position to identify the bills by the identifying sensor is set between the separation/feeding-out device and the taking-out device.

In such a bill counter, according to the first embodiment, when a bundle of bills containing 1,000-yen bills, 5,000-yen bills and 10,000-yen bills at random is trued up and inserted to the insertion port, the bundle of bills inserted to the insertion port is fed out one by one sequentially from the lowest bill in the bundle by means of the frictional force on the outer peripheral face of the rotating body.

The bills fed out by the first feeding-out device is handed over to the second feeding-out device and then fed out one by one toward the taking-out port. In this case, the tip ends of the bills other than the first bill overlapping with each other in the state that the tips thereof are slipped out of place are held by the control member, while the first bill is fed out toward the taking-out port by means of the frictional force of the rotation roller. The bill fed out by the second feeding-out device is identified whether it is true or forged, or the kind and the number of sheets of each bill are identified and the information thereof is input to the control section. The control section outputs a signal based on the signal from the identifying sensor to display the number of 1,000-yen bills, 5,000-yen bills and 10,000-yen bills and the total amount at the display section.

Furthermore, when a forged bill is detected by the identifying sensor, the operation of the driving section is stopped to stop the counting of bills. Thereby, it works as a device for finding forged bills. Moreover, this counter can be carried and is not restricted by the place where it is used.

According to the second embodiment, when a bundle of bills containing 1,000-yen bills, 5,000-yen bills and 10,000-yen bills at random is trued up and inserted to the setting port, the bundle of bills supplied from the setting port is fed out one by one by the separation/feeding-out device. The fed-out bills are fed out one by one toward the taking-out port, while the fed-out bills are identified whether it is true or forged, or the kind and the number of sheets of each bill are identified and the information thereof is input to the control section. The control section outputs a signal based on the signal from the identifying sensor to display the number of 1,000-yen bills, 5,000-yen bills and 10,000-yen bills and the total amount at the display section.

Furthermore, when a forged bill is detected by the identifying sensor, the operation of the driving section is stopped to stop the counting of bills, thereby it works as a device for finding forged bills. In these series of operations, it becomes possible to take out the bill one by one securely without letting them stay inside by a taking-out device having a fast taking-out speed, though being compact, and it further becomes possible to identify correctly the bills by an encoder.

BRIEF DESCRIPTION OF THE DRAWINGS

The present invention will be better understood from the following detailed description of preferred embodiments of the invention, taken in conjunction with the accompanying drawings, in which like reference numerals refer to like parts, and in which.

DETAILED DESCRIPTION OF THE PREFERRED EMBODIMENTS

The first embodiment of the present invention will now be described in detail with reference to the accompanying drawings, FIGS. 1–11.

Figure 8:
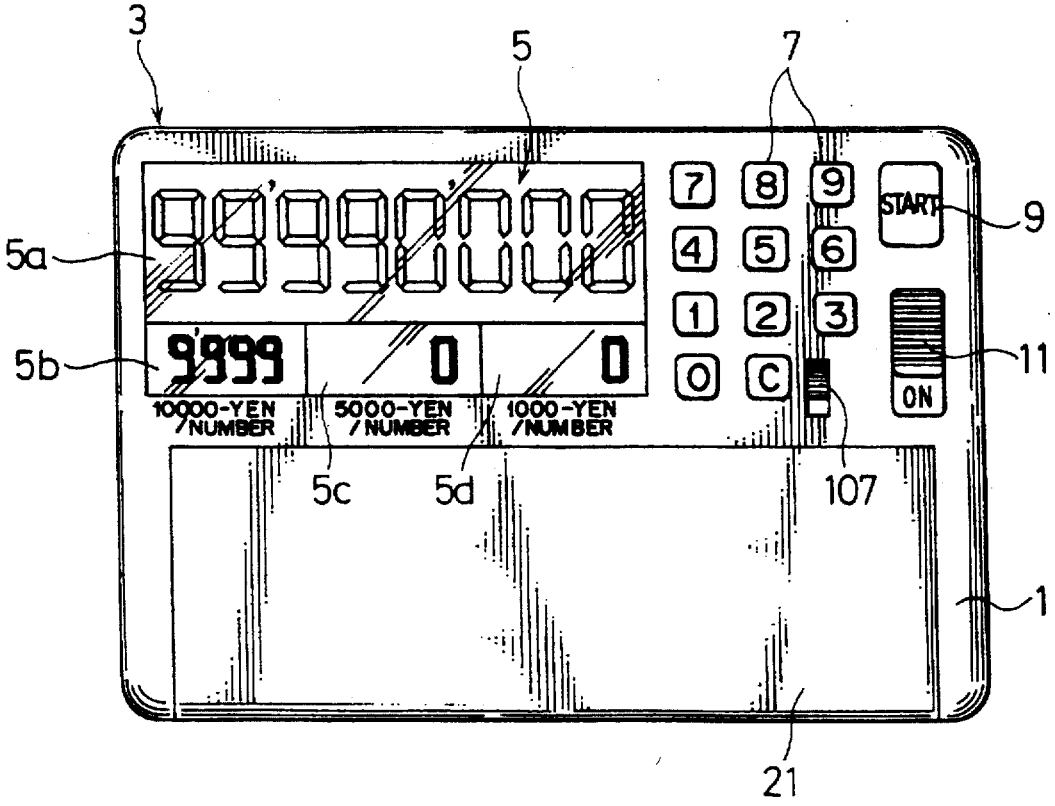
FIG. 8 is a view illustrating the state of the display when a voltage is applied.

Referring to FIG. 8, reference numeral 1 represents a case body of a bill counter 3, having a size like a tobacco box and a shape which can be held by a single hand.

On the surface of the case body 1, there are respectively provided a display section 5, setting keys 7, a start key 9, and a power switch key 11.

The display section 5 is a liquid crystal display, and the upper side is a display section **5*a* for the total amount. The lower side of the display section 5*a* for the total amount becomes a display section 5*b* for the number of 10,000-yen bills, a display section 5*c* for the number of 5,000-yen bills, and a display section 5*d*** for the number of 1,000-yen bills.

The setting key 7 has a figure printed on the upper face thereof, and by pushing the setting key 7, the number of sheets of bills to be taken out is specified.

On the other hand, the one side of the case body 1 (the lower side of FIG. 2) becomes the insertion port 13 which can be expanded/contracted, and the other side (the upper side of FIG. 2) becomes the taking-out port 15. The insertion port 13 and the taking-out port 15 are connected with each other by a guide plate 17 which forms a transfer path face **17*a*, and the guide plate 17 is fixed and supported within the case body 1**.

It is made possible to insert bills in a bundle to the insertion port 13 by opening the opening/closing lid 21 which can be opened/closed by using an attachment hinge 19 as a fulcrum, and by opening/closing the opening/closing lid 21, the insertion port 13 can be expanded/contracted.

Figure 10:
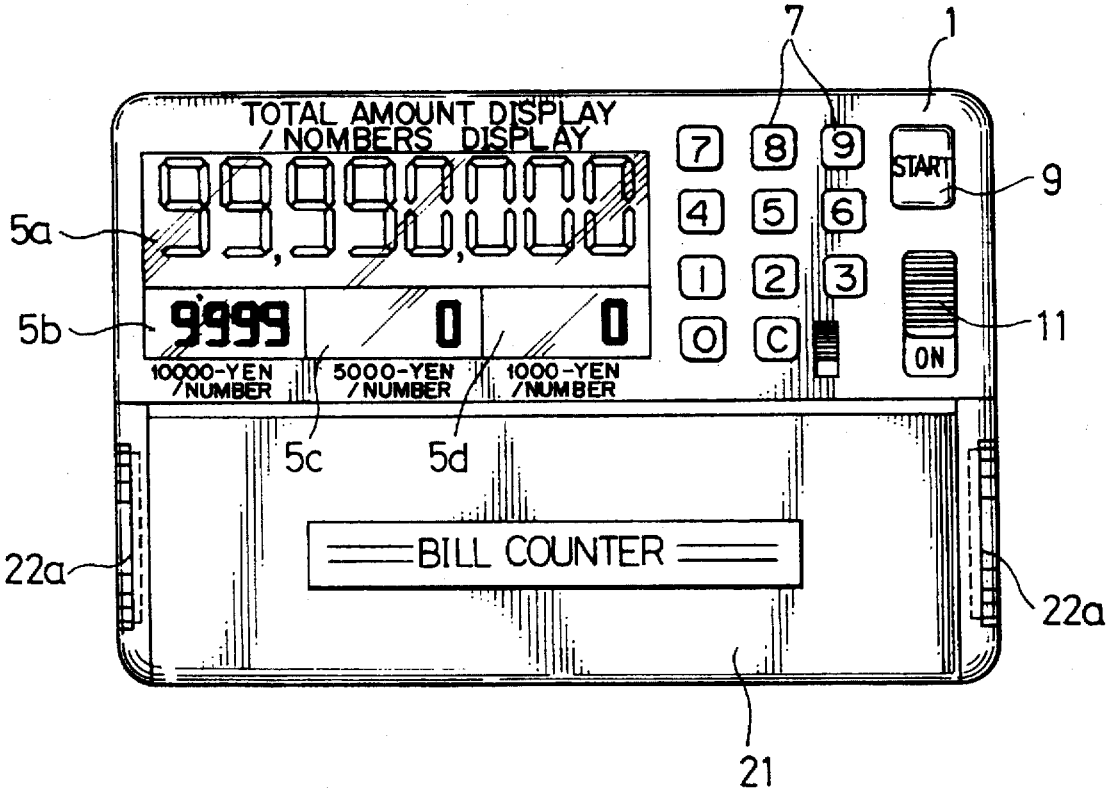
FIG. 10 is an elevational view of the bill counter showing a modified embodiment of the opening/closing door.
Figure 11:
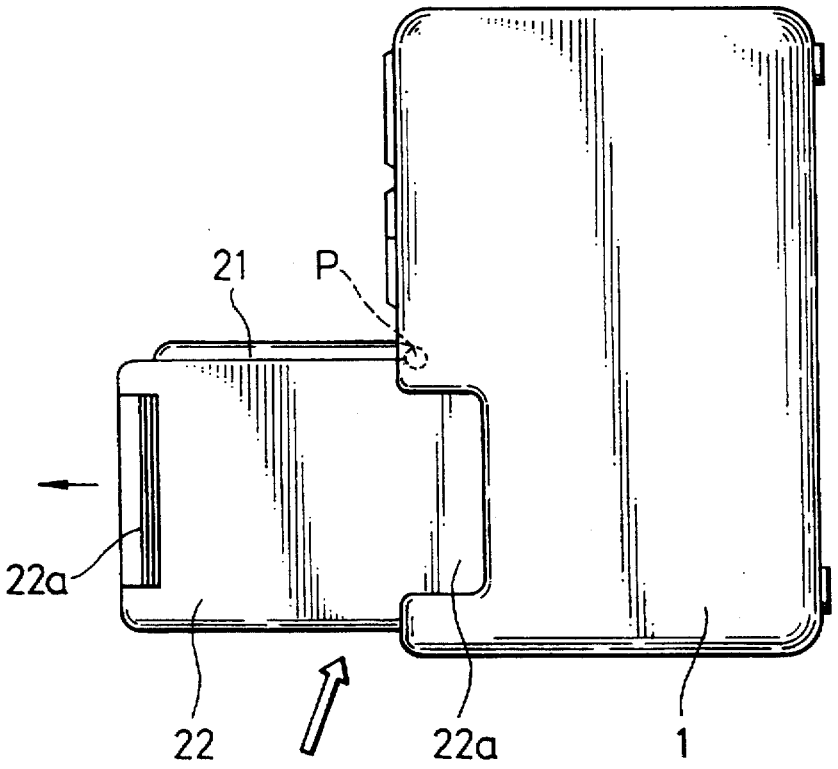
FIG. 11 is a side view of FIG. 10 in which the opening/closing door is opened.

In addition, the opening/closing lid 21 is supported openably so as to always rotate toward the direction of the blocking arrow using the hinge P as a fulcrum, as shown in FIGS. 10 and 11. On the other hand, it may be a drawer-type opening/closing type which can be opened like the phantom line by holding both handle portions **22*a* of the drawer body 22** and pulling it forward.

The taking-out port 15 is set to have a diameter through which bills can pass one by one.

On the insertion port side 13 within the case body 1, there are provided a bill-detecting switch 23 for detecting the presence of bills and the first feeding-out device 25, and on the taking-out port 15 side, there are provided the second feeding-out device 27 and the identifying sensor 29, respectively.

The bill-detecting switch 23 detects the presence of bills by being pressed by a bill which projects from the transfer path face **17*a* of the guide plate 17*a* and is inserted to the insertion port 13, and when it detects that there is no bill, even if the start key 9 is operated, the operation of the start key 9 is not effected through the control section 31** described below.

The first feeding-out device 25 comprises right and left rotation rollers 35 which are rotatably and pivotally attached to the roller shaft 33, and a pressed body 37 arranged at a position opposite to the right and left rotation rollers 35. The outer peripheral face of the rotation roller 35 has a friction face secured by the quality of the material such as rubber and the like, as well as having a shape that a part of the outer peripheral face projects from the transfer path face **17*a* of the guide plate 17 via a notch window. In this case, the rotation roller 35** may be a belt-type. Furthermore, with regard to the number of rotation rollers, there may be only one provided in the central portion, and is not restricted to the right and left rollers.

Figure 4:
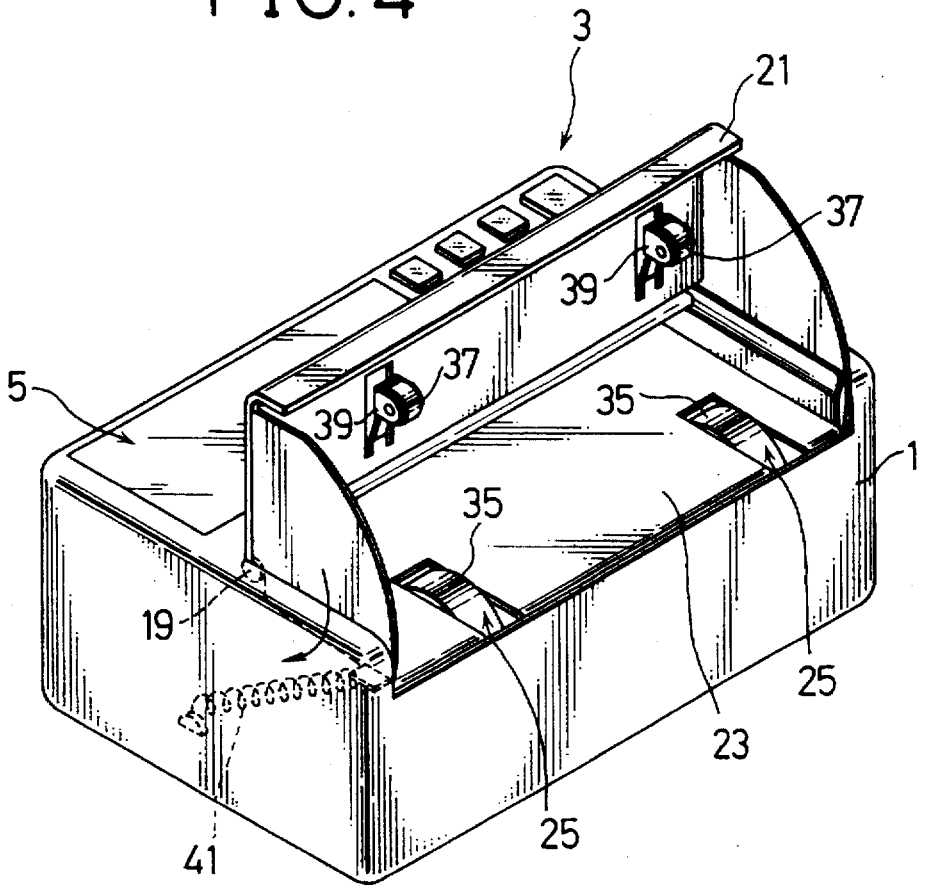
FIG. 4 is a perspective view in which an opening closing lid of the bill counter is opened.

The pressing body 37 is a roller type which is rotatably supported against the supporting bracket 39 attached to the opening/closing lid 21, as shown in FIG. 4, and the pressing action toward the rotation roller 35 is secured by a force spring 41 which energizes the opening/closing lid 21 always toward the closing direction (shown by an arrow in FIG. 4). In addition, the one end of the force spring 41 is connected to the side plate of the opening/closing lid 21 and the other end thereof is connected to the case body 1 side, respectively.

Thereby, the pressing body 37 is strongly brought into contact with the outer peripheral face of the rotation roller 35, and the action to press the bill toward the rotation roller 35 side is effected.

The second feeding-out device 27 has a pair of right and left rotation rollers 43 and a control member 45, and the rotation rollers 43 are double rollers having a geared pulley at the central portion thereof, and pivotally attached rotatably to the roller shaft 49.

The outer peripheral face of the rotation roller 43 is formed on the friction face by the quality of the material, such as rubber and the like, as well as having a shape that a part of the outer peripheral face projects from the transfer path face 17*a* of the guide plate 17 via a notch window.

Figure 1:
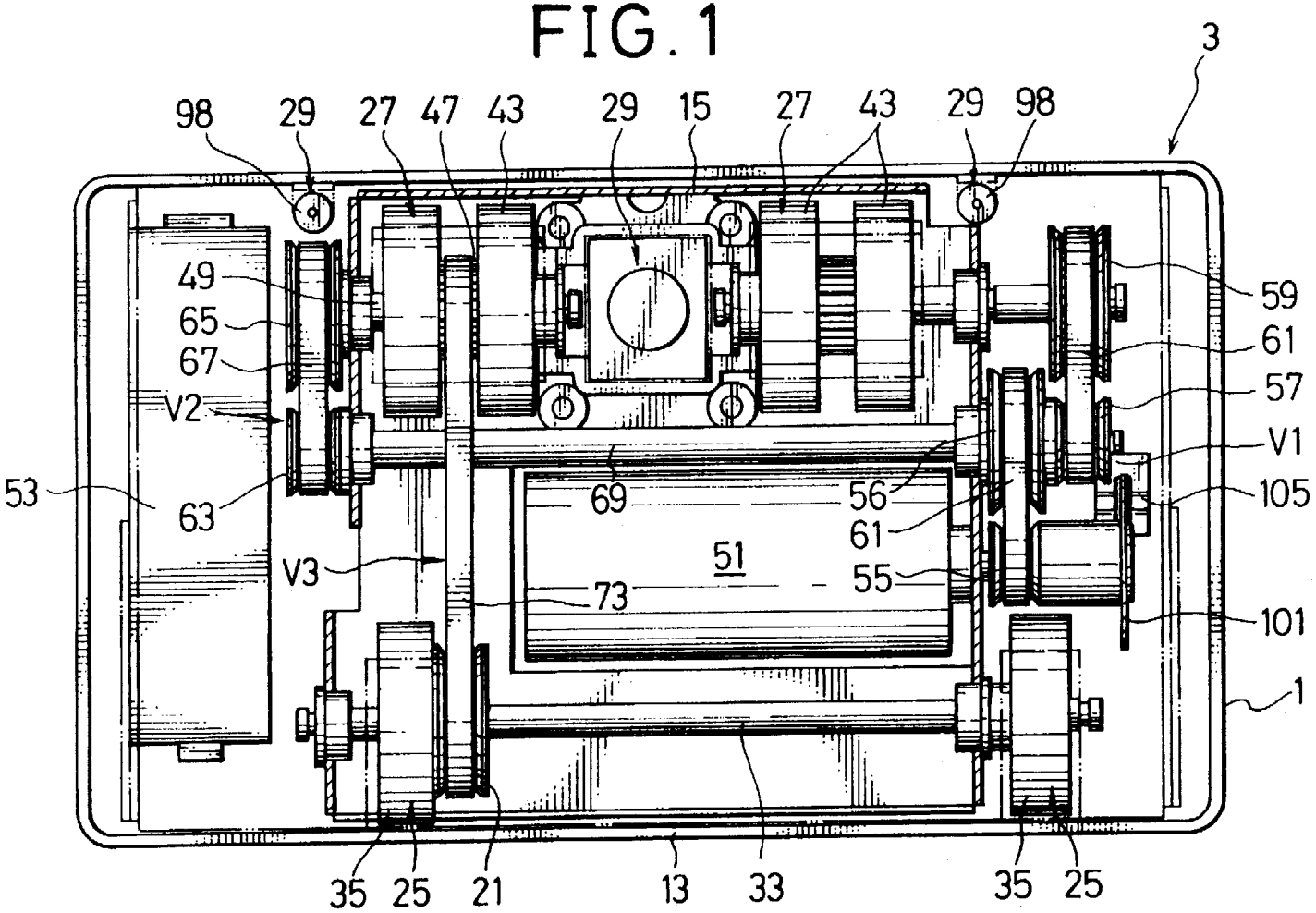
FIG. 1 is a schematic elevational view showing the inner structure of the bill counter according to the present invention.
Figure 2:
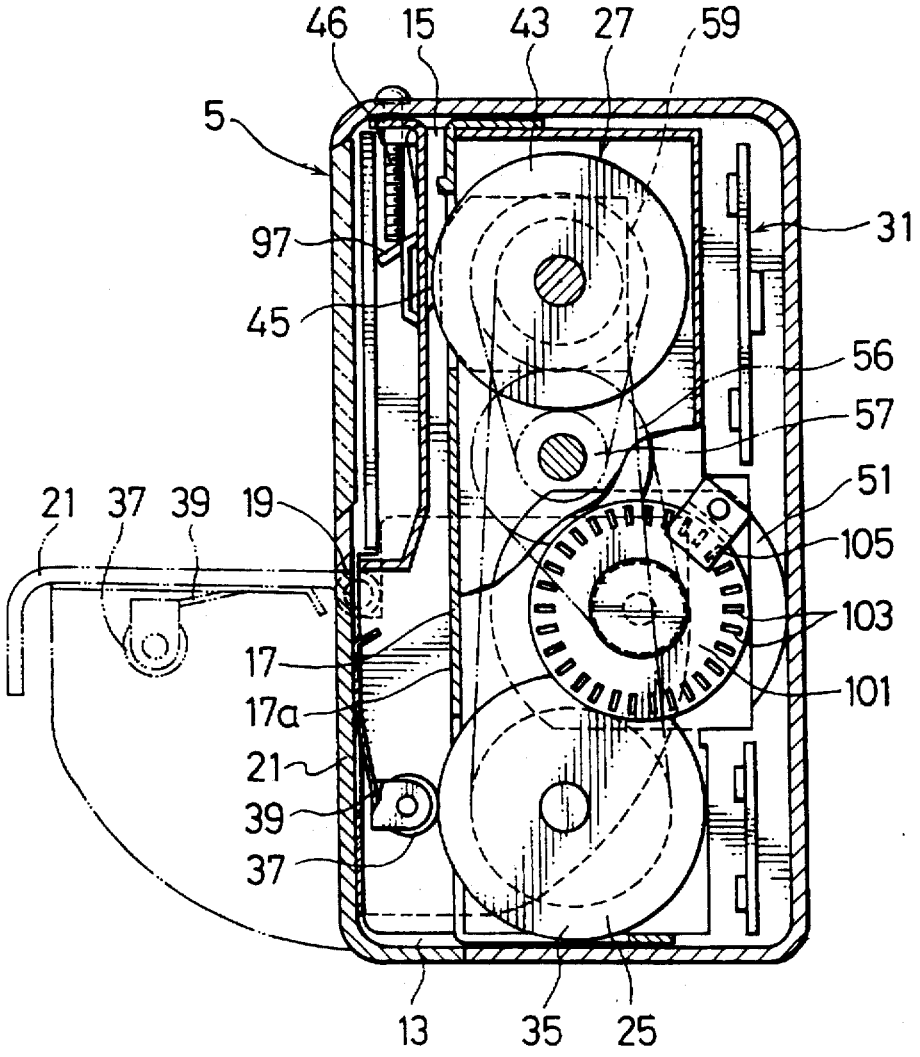
FIG. 2 is a schematic sectional side view of the bill counter.

The rotation rollers 35 of the first feeding-out device 25 and the rotation rollers 43 of the second feeding-out device 27 have the rotation power provided from the driving motor 51 via the first, the second and the third transfer systems VI, V2 and V3, as shown in FIG. 1.

The driving motor 51 is a direct-current motor which uses, as a power supply, the direct current from a dry battery 53 exchangeable by opening/closing a lid of the dry battery, or from an adaptor (not shown) which converts the alternating current into the direct current, and is operated and controlled based on the signal from the control section 31 described below.

The first transfer system VI comprises timing belts 61 which are hung on the geared first pulley attached to the motor shaft of the driving motor 51, the geared second and third double pulleys 56 and 57 arranged midway, and the geared fourth pulley 59 attached to the pulley shaft 49 of the rotating pulley 43 on the right side of the second feeding-out device 27.

The double second and third pulleys 56 and 57 which are arranged midway become pulleys for reducing the speed, whose pulley ratio is different from that of the first and the fourth pulleys 55 and 59.

The second transfer system V2 comprises a timing belt 67 which is hung on the geared fifth pulley 63 arranged on the left side, opposite to the second and the third pulleys 56 and 57 which are the pulleys for reducing the speed, and the geared sixth pulley 65 attached to the pulley shaft 49 of the rotating pulley 43 on the left side of the second feeding-out device 27. The fifth pulley 63 is attached integrally with the double second and third pulleys 56,57 via a transfer shaft 69.

The third transfer system V3 comprises a timing belt 73 which is hung on the geared seventh pulley 71 provided in parallel with the left rotation roller 35 of the first feeding-out device 25, and the geared pulley 47 provided in the central portion of the rotation roller 43 on the left side of the second feeding-out device 27. The pulley ratio of the seventh pulley 71 and the geared pulley 47 are different from each other, thereby the rotation number of the rotation roller 43 of the second feeding-out device 27 becomes faster than that of the rotation roller 35 of the first feeding-out device 25.

The rotation rollers 35 on the right and left of the first feeding-out device 25 operate in such a manner that the bill fed out from said rollers 35 meshes simultaneously with the rotation roller 43 of the second feeding-out device 27, thereby at the time of generation of load due to the difference of rotation between each roller 35 and 43, the rotation rollers 35 having a slower rotation speed run idle by right and left sliding clutches 75 and 77.

Figure 6:
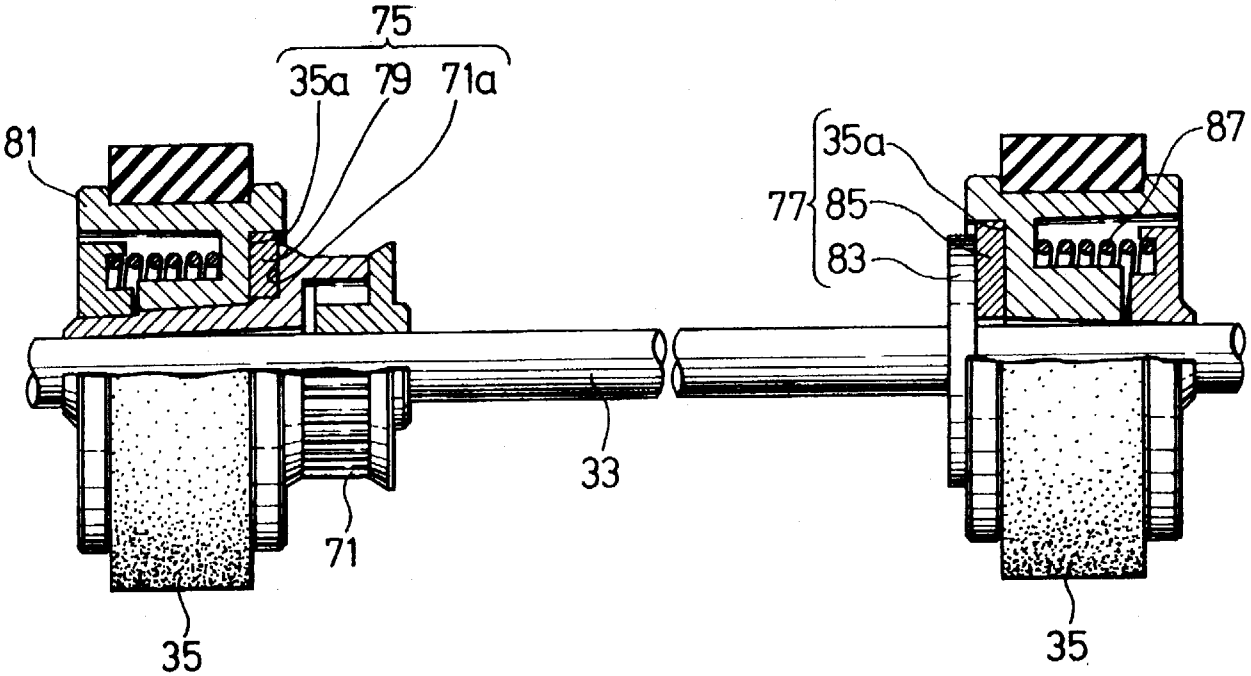
FIG. 6 is a partial sectional view showing a sliding clutch.

The left sliding clutch 75 is, as shown in FIG. 6, provided with a clutch member 79 attached between a roller disk face 35*a* of the rotation roller 35 attached freely rotatably to a roller shaft 33 and a pulley disk face 71*a* of the seventh pulley 71 attached integrally with the roller shaft 33. The roller disk face 35*a*, the clutch member 79 and the pulley disk face 71*a* are press-bonded by the spring pressure by a force spring 81 provided on the rotation roller 35 side, and when load exceeding this press-bonding force is effected, the roller disk face 35*a* and the pulley disk face 71*a* slide over the clutch member 79 therebetween.

Furthermore, the right sliding clutch 77 is provided with a clutch member 85 attached between a roller disk face 35*a* of the rotation roller 35 attached freely rotatably to the roller shaft 33 and a frange portion 83 which stands up from the roller shaft 33. The roller disk face 35*a*, the clutch member 85 and the frange member 83 are press-bonded by the spring pressure by a force spring 87 provided on the rotation roller 35 side, and when load exceeding this press-bonding force is effected, the roller disk face 35*a* and the frange member 83 slide over the clutch member 85 therebetween. However, when a driving motor having a weak rotation torque is used, the structure of the sliding clutches 75 and 77 is not always required.

Figure 5:
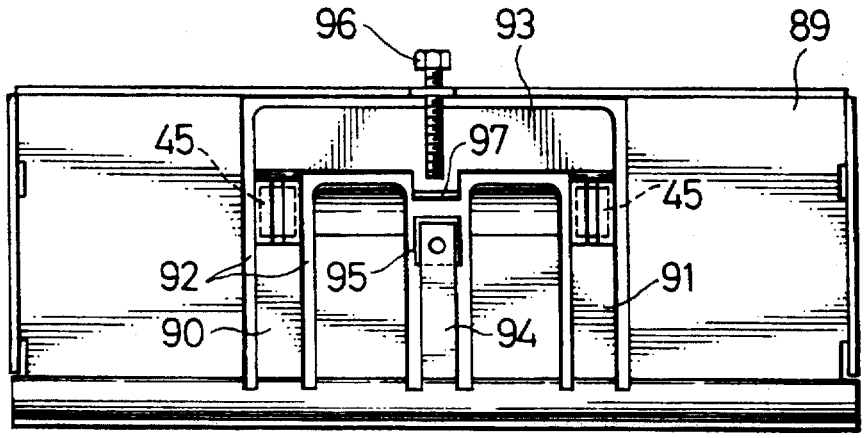
FIG. 5 is an elevational view of the supporting plate.

The control member 45 is composed of a rubber pad, and as shown in FIG. 5, is firmly fixed to right and left supporting pieces 90,91 formed on a supporting plate 89 fixed and supported within the case body 1.

The right and left supporting pieces 90,91 are formed by forming a reverse U-shaped notch groove 93 on the supporting plate 89, and the upper end of the supporting pieces 90 and 91 are connected integrally with each other via a coupling portion 93. An independent tongue-like elastic piece 94 is formed between the supporting piece 90 and the supporting piece 91 on right and left, and a magnetic sensor pad 95 made of a synthetic resin is provided on this elastic piece 94.

Figure 3:
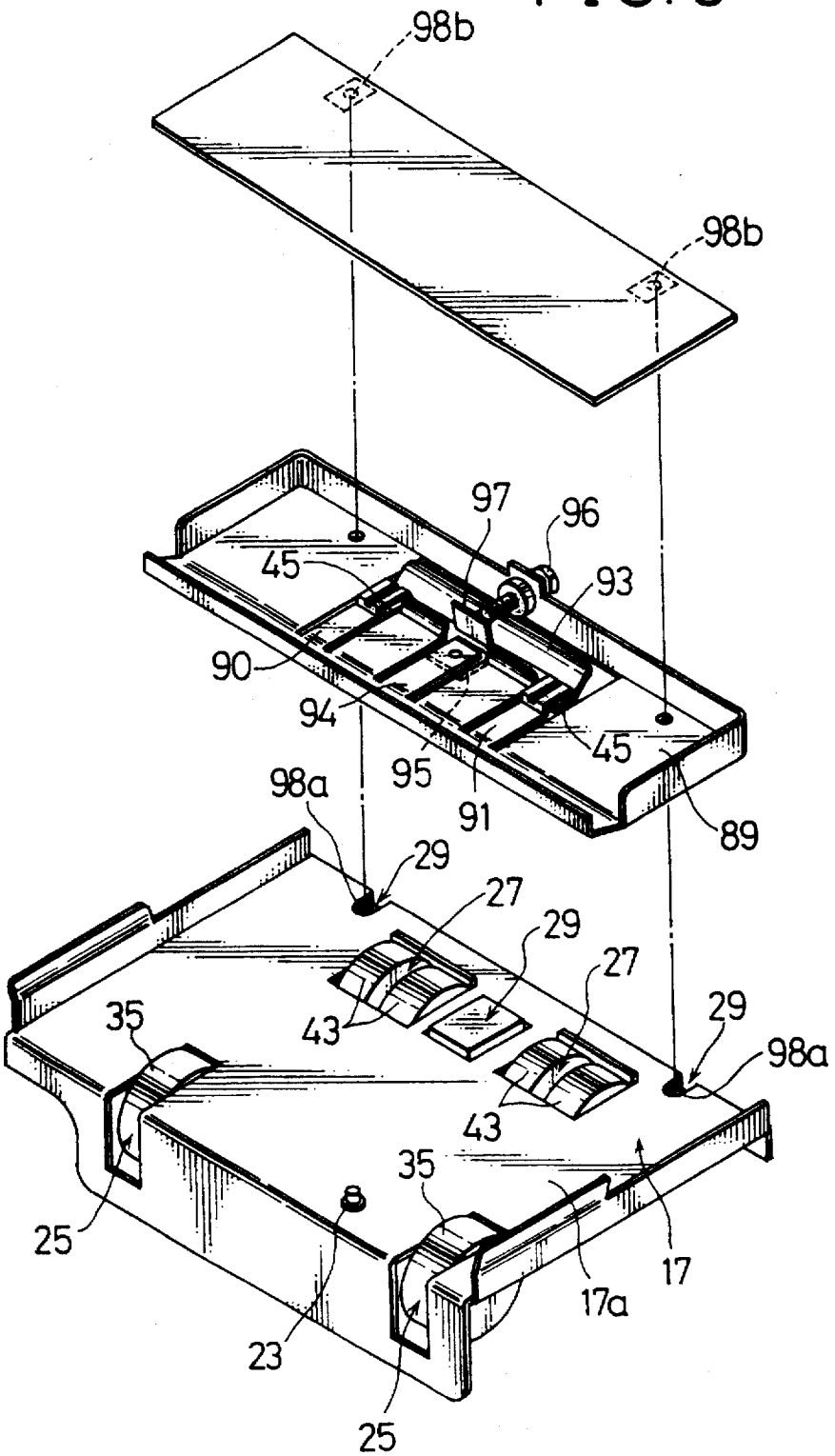
FIG. 3 is an exploded perspective view removing a supporting plate from a guide plate.

Said control members 45 formed on the rubber pad are positioned at a point arranged between rotation rollers 43 formed in double, as shown in a chain line of FIG. 3, and works to make a part of bills depressed in U-shape, as well as each supporting piece 90 and 91 rotates (as shown by an arrow in FIG. 2) using the base portion as a fulcrum by means of an adjustment screw 96, thereby it becomes possible to control the movement of said control member 45 forward or backward against the rotation roller 43. The adjustment screw 96 is screwed to the supporting plate 89, and the tip of the adjustment screw 96 abuts against the standing-up wall 97 standing up from said coupling portion 93. Therefore, by expansion and contraction of the adjustment screw 96, the tip thereof abuts strongly or weakly against the standing-up wall 97, thereby the control member 45 can obtain an advancing state approaching to the rotation roller 43 and a retreating state parting from the rotation roller 43 to make it possible to adjust the optimum control position for holding the tip end of the second bill overlapping with the first bill.

The identifying sensor 29 is composed of a combination of a photosensor 98 comprising a light-emitting element 98*a* and a light-receiving element 98*b* opposite to each other at the upper and lower position arranged on right and left outside of the rotation roller 43, and a magnetic sensor 99 arranged between the rotation rollers 43.

The photosensor 98 works to detect the reading of pattern of bills at each position, the pattern recognition, and the transmitted pattern and the like by the encoder 100, and the detection signal thereof is input to the control section 31.

The magnetic sensor 99 detects the magnetism by unit of bills contained in the ink by pressing the bill from the upper side by a magnetic sensor pad 95, and the detection signal thereof is input to the control section 31.

The encoder 100 works to detect the feed ratio of the rotation roller 43 by counting the number of rotation of a rotation plate 101 attached to the first pulley 55 by the number of transmitting holes 103 provided at even intervals on the rotation plate 101 by a photo element 105, and the detection signal thereof is input to the control section 31.

The control section 31 has information such as, for example, figures and magnetic quantity by unit of each bill preliminarily input thereto, and carries out the operation based on the signals from each sensor to output the signal showing the number of sheets by unit of each bill and the total amount to the display section 5, while it works to stop the operation of the driving motor 51 when a forged bill is detected. In addition, by making the identifying sensor 29 with the overseas specification according to the country, it can be used overseas. In this case, it is necessary to input the information corresponding to the overseas specification to the control section 31.

According to the bill counter 3 thus constituted, when a bundle of bills including 1,000-yen bills, 5,000-yen bills and 10,000-yen bills at random is inserted to the insertion port 13 and the start key 9 is pushed, the bills are fed out one by one by the operation of the first and the second feeding-out devices 25 and 27, and can be taken out from the taking-out port 15.

At the time of this operation, the bills other than the first bill overlapping with each other in a state that the tips thereof slip out of place are held at the tip end by the control member 45, and simultaneously, the first bill is fed out sequentially toward the taking-out port 15 with the frictional force by the rotation roller 43. At this time, the bill is identified by the identifying sensor 29 whether it is true or forged, or the kind and the number of sheets of each bill are identified, and input to the control section 31. The control section 31 outputs a signal based on the signal from the identifying sensor 29. Thereby, as shown in FIG. 8, the number of 1,000-yen bills, 5,000-yen bills and 10,000-yen bills and the total amount are displayed at the display section 5.

Furthermore, when a forged bill is detected by the identifying sensor 29, the operation of the driving motor 51 is stopped. Thereby, it is made possible to find a forged bill.

Figure 9:
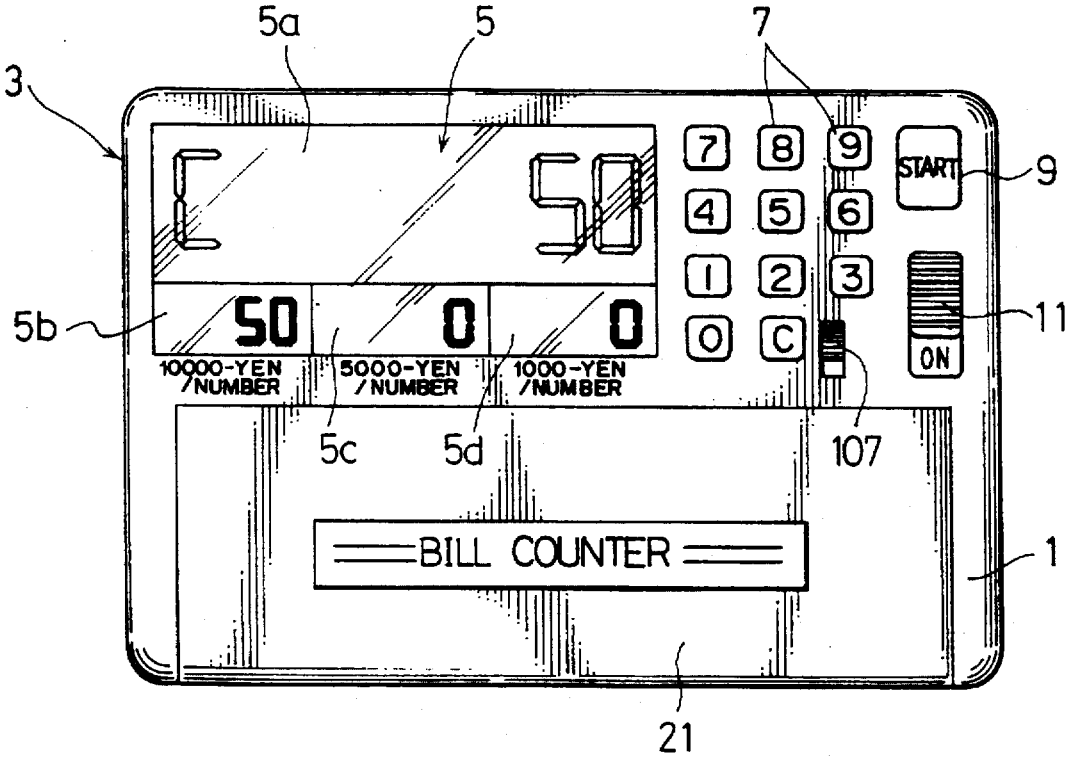
FIG. 9 is a view illustrating the state of the display that voltage is applied.

Next, as an alternative usage, when it is desired to take out the necessary number of sheets from the bundle of, for example, 10,000-yen bills, insert a bundle of 10,000-yen bills and push the setting key 7 to set the number of sheets to the total-amount display section 5*a*, as shown in FIG. 9. Then, by operating the start key 7, bills are fed out sequentially from the taking-out port 15 and when the identifying sensor 29 detects the number of sheets set in advance, the detection signal is input to the control section 31. The control section 31 stops the operation of the driving motor 51 based on the detection signal. Thereby, for example, the number of sheets is displayed on the display section 5*b* for the number of sheets of 10,000-yen bills, while the necessary number of sheets can be taken out from the taking-out port 15.

Figure 7:
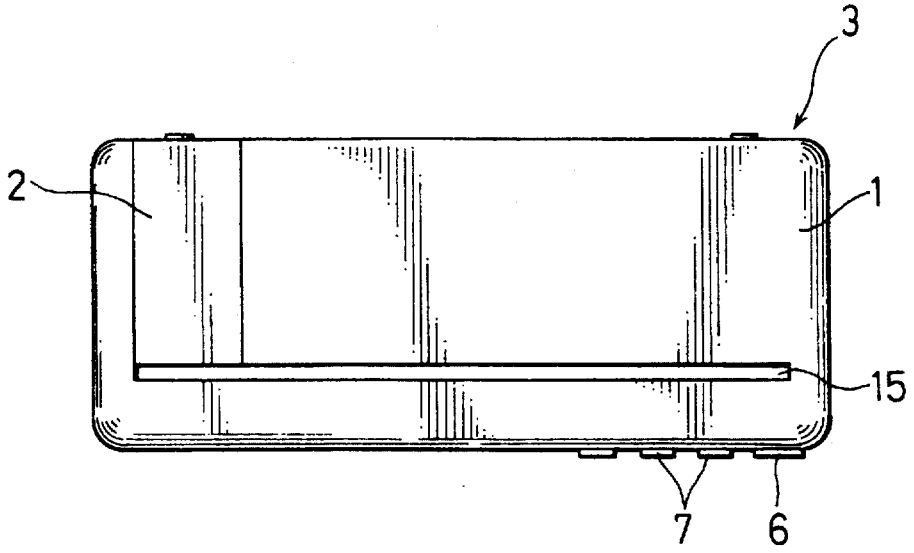
FIG. 7 is a plan view of the bill counter.

In addition, in this embodiment, the description is made with reference to the bills, however, by providing a change-over switch 107 having functions of "bill" and "others," as shown in FIG. 7, it can be planned to enlarge the range to be used for book coupons, public lottery tickets, and gift certificates by the switching operation of "others" of the change-over switch 107.

Figure 12:
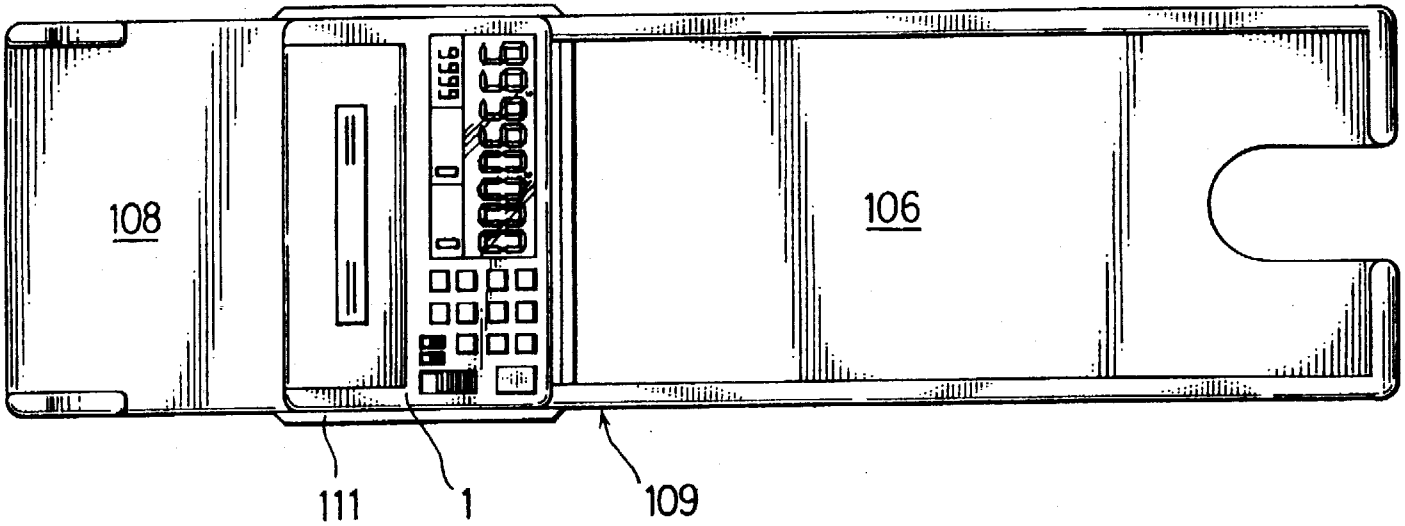
FIG. 12 is a plan view showing the state that the bill counter is set to a setting table.
Figure 13:
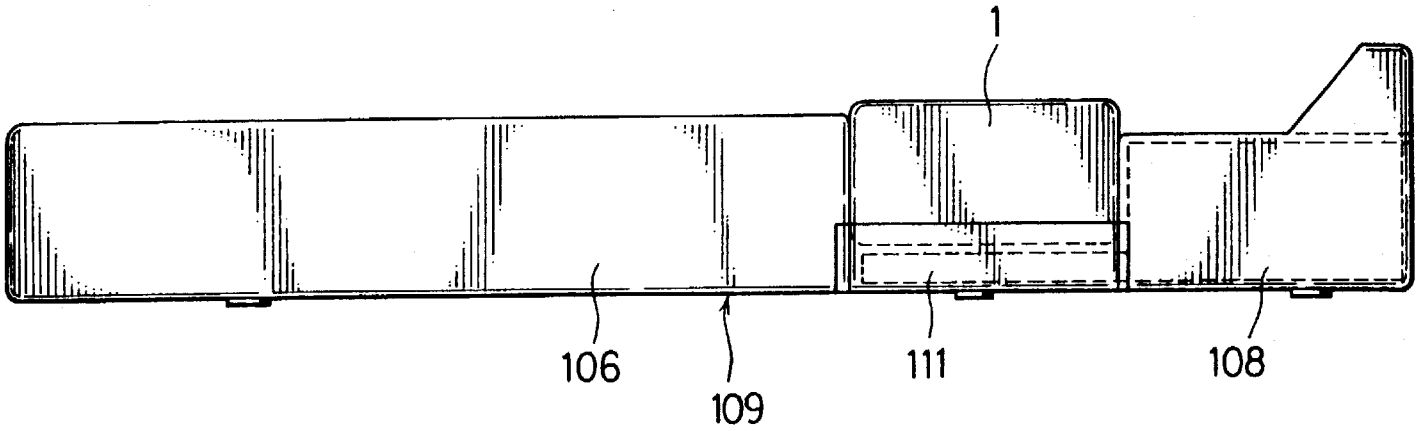
FIG. 13 is a side view of FIG. 12.

Furthermore, in this embodiment, the bill counter can be used in a state held by hand, however, as shown in FIGS. 12 and 13, by being attached to the attachment portion 111 of the setting table 109 having a bill-receiving section 106 and a power supply section 108, it can be used as a table-type. Therefore, the bill taken out from the taking-out port 15 is put in order on the bill-receiving section 106.

FIGS. 14–20 show the second embodiment of the bill counter 115. In the drawings, reference numeral 113 represents a case body of the bill counter 115, and is made in a size which can be carried easily.

The case body 113 has a combination structure detachable via a bill-receiving section 114 and a coupling section 116, but it may be a shape in which the case body 113 and the bill-receiving section 114 are integrally formed continuously.

On the surface of the case body 113, there are provided a display section 117, setting keys 119 and a start key 120, respectively.

The display section 117 is a liquid crystal display, and the upper side thereof is the display section 117*a* for the total amount. The lower side (left side in the drawing) of the display section 117*a* for the total amount becomes a display section 117*b* for the number of 10,000-yen bills, a display section 117*c* for the number of 5,000-yen bills, and a display section 117*d* for the number of 1,000-yen bills.

The setting key 119 has a figure printed on the upper face thereof, and by pushing the setting key 119, the number of bills to be taken out is specified.

On the other hand, the one side of the case body 113 (the right side of FIG. 17) becomes the setting port 121, and the other side (the left side of FIG. 17) becomes the taking-out port 123. The setting port 121 and the taking-out port 123 are connected with each other by a first guide plate 125 and a second guide plate 127 which form a transfer path face, and the second guide plate 127 is fixed and supported substantially horizontally. The first guide plate 125 arranged on the setting port 121 side is fixed and supported in an inclined state which declines from outside toward inside, while having an auxiliary guide plate 129 provided thereto.

The auxiliary guide plate 129 is stretchably supported obliquely upward along the inclined first guide plate 125.

The taking-out port 123 is set to have a diameter through which bills can pass one by one.

On the setting port side 121, there are provided feeding rollers 131 and a separation/feeding-out device 133, and on the taking-out port 123 side, there are provided a taking-out device 135 and an identifying sensor 137, respectively.

The feeding rollers 131 are arranged on right and left and rotatably and pivotally attached to the roller shaft 139. The outer peripheral face of the feeding rollers 131 has a friction face secured by the quality of the material such as rubber and the like, as well as having a shape that a part of the outer peripheral face projects from the transfer path face 125*a* of the first guide plate 125 via a notch window.

The separation/feeding-out device 133 comprises first rollers 141, second rollers 143 and holding rollers 145, the first rollers 141 being pivotally attached rotatably on right and left of the roller shaft 147, and composed of geared double rubber rollers having a peripheral groove 149 in the central portion. The geared roller faces 151 thereof have a shape projecting partly from a notch window of the second guide plate 127. The holding rollers 145 are firmly adhered to an eccentric shaft 153, and faces into the peripheral grooves 149 of the first right and left rollers 141, and work to hold the surface of a bill W down into the peripheral groove 149, thereby the contact face pressure for the feeding operation which feeds out the bill by the frictional force by the geared roller face 151 is secured. The contact face pressure for the feeding operation can be adjusted by rotating a rotation handle 155 provided at the shaft end of the eccentric shaft 153 from an adjusting window 157 toward right or left to move the holding rollers 145 upward or downward by the volume of eccentricity of the eccentric shaft 153. The second rollers 143 are energized downward so as to be brought into contact with the geared roller faces 151 inside of the first rollers 141, as well as being supported horizontally movably by a supporting arm 159 extended from the eccentric shaft 153 of the holding rollers 145.

The taking-out device 135 has a pair of right and left rotation rollers 161 and a pressing roller 163 opposite to the rotation rollers 161, and the pressing roller 163 is brought into contact with the rotation rollers 161 and pivotally and rotatably hung thereon. The rotation rollers 161 are rotatably and pivotally attached to the roller shaft 165, and the outer peripheral face thereof is formed on the friction face by the quality of the material such as rubber and the like, while having a shape that a part of the outer peripheral face projects from the transfer path face 127*a* of the second guide plate 127 via a notch window.

Figure 14:
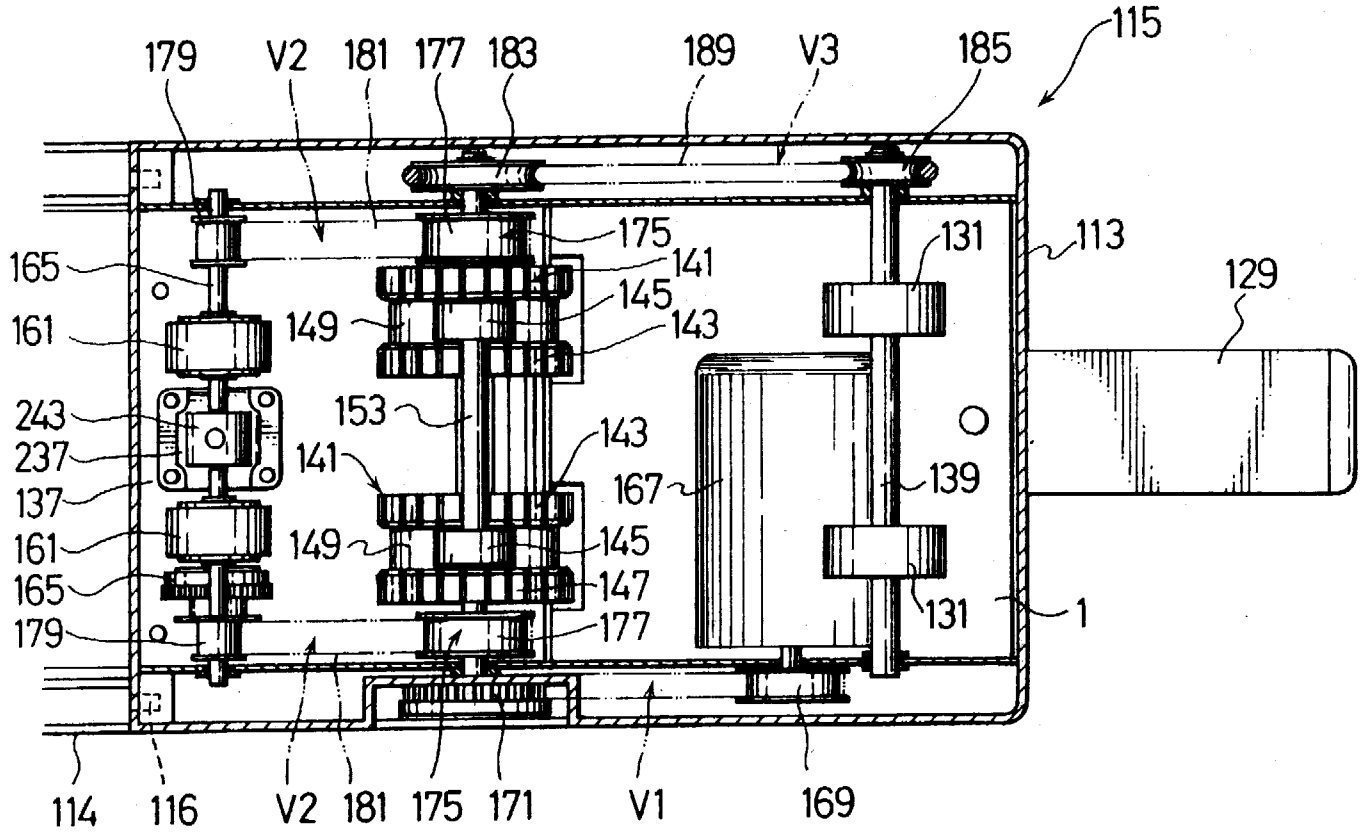
FIG. 14 is a schematic plan view of the bill counter showing the second embodiment.
Figure 15:
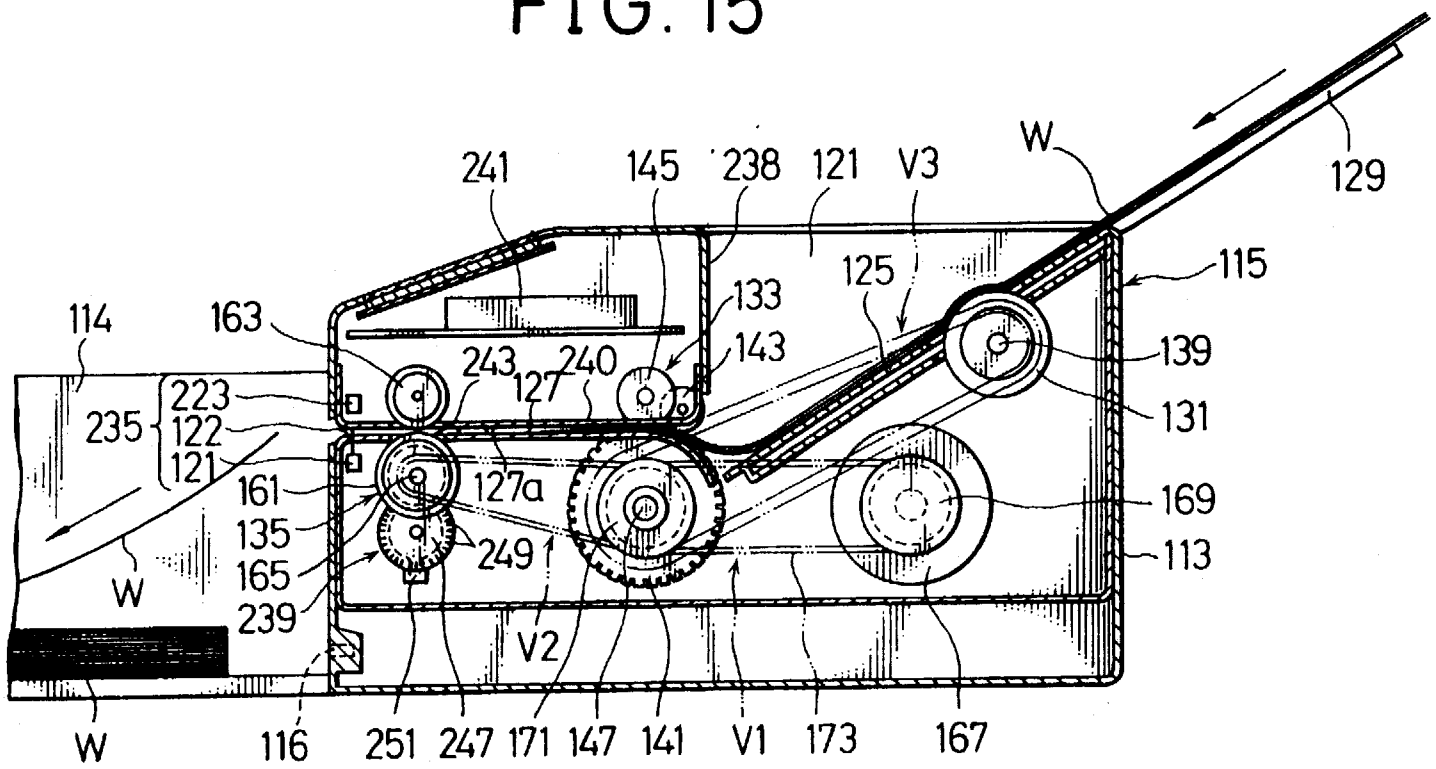
FIG. 15 is a sectional view of the bill counter showing the second embodiment.
Figure 16:
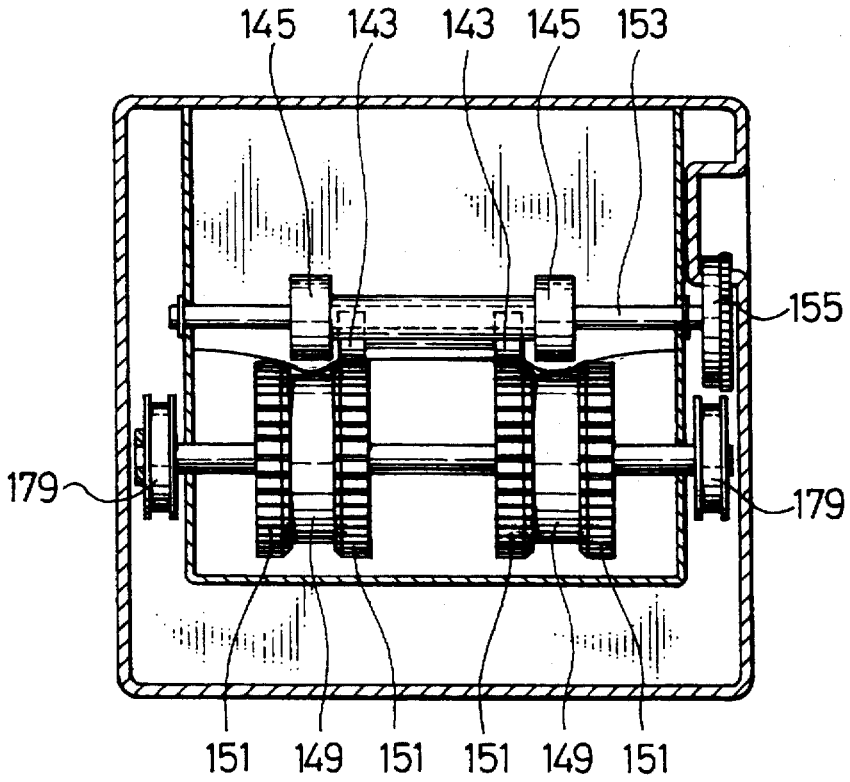
FIG. 16 is a view illustrating a separation/feeding-out device.

The feeding rollers 131, the first rollers 141 of the separation/feeding-out device 133, and the rotation rollers 161 of the taking-out device 135 are, as shown in FIG. 14, provided with a rotation power from the driving motor 167 via the first, the second and the third transfer systems V1, V2 and V3.

The driving motor 167 is a direct-current motor which uses the direct current from a dry battery or from an adaptor (either of them is not shown) which converts the alternating current into the direct current as a power supply, and is operated and controlled based on the signal from the control section 241 described below.

The first transfer system V1 comprises a transfer belt 173 which is hung on the first pulley 169 attached to the motor shaft of the driving motor 167, and the second pulley 171 provided on the roller shaft 147 of the first rollers 141 of the separation/feeding-out device 133.

The second transfer system V2 comprises a timing belt 181 which is hung on the third pulley 177 on right and left having a sliding clutch 175 inside thereof, and the fourth pulley 179 provided on the roller shaft 165 of each rotation roller 161 of the taking-out device 135. The fourth pulley 179 is set so as to have a pulley ratio smaller than that of the third pulley 177, and the peripheral speed of the rotation roller 161 is made faster than that of the first roller 141. Thereby, the taking-out speed of the bill W by the rotation rollers 161 becomes faster than the feeding-out speed of the bill W by the first roller 141, so it prevents the bill W from staying and secures the reliable taking-out state.

The third transfer system V3 comprises a transfer belt 189 hung on the fifth pulley 183 provided on the roller shaft 147 of the first rollers 141 of the separation/feeding-out device 133, and the sixth pulley 185 provided on the roller shaft 139 of the feeding roller 131.

Figure 20:
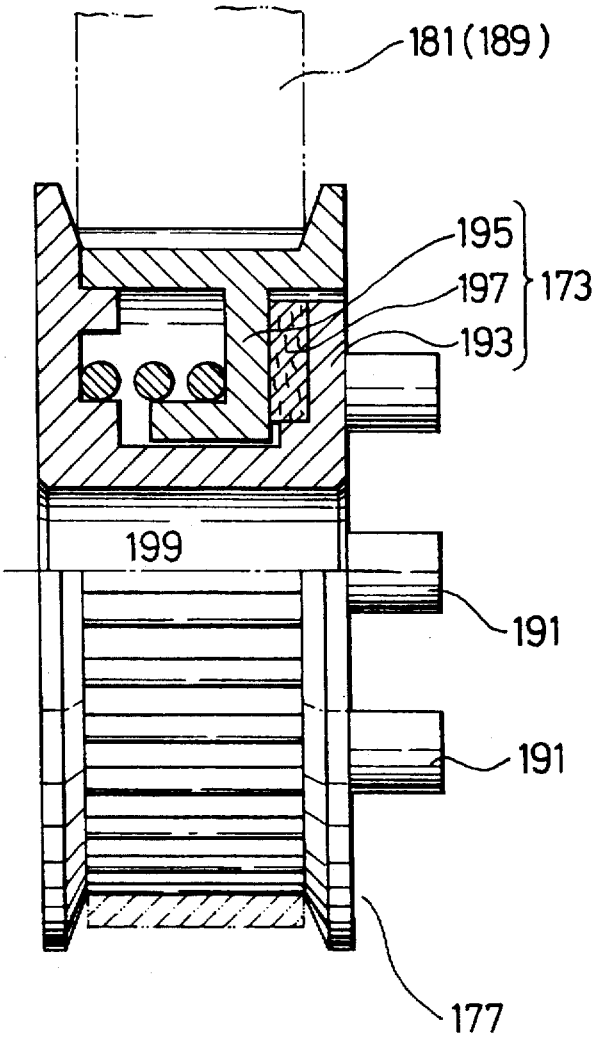
FIG. 20 is a sectional view of the sliding clutch provided in the third roller.

The sliding clutch 176 provided on the third pulley 177 is, as shown in FIG. 20, attached freely rotatably to the roller shaft 147, and a clutch member 197 is attached between a roller disk portion 193 of the third pulley 177 integrally coupled to the second pulley 171 and the fifth pulley 183, respectively, via the projecting portion 191, and a pulley disk portion 195 which is attached rotatably to the roller disk portion 193 and on which the timing belt 181 and the transfer belt 189 are hung. The roller disk portion 193, the clutch member 197 and the pulley disk portion 195 are press-bonded by the spring pressure by a force spring 199, and when load exceeding this press-bonding force is effected, the roller disk portion 193 and the pulley disk portion 195 slide over the clutch member 197 therebetween to block the power transfer to the timing belt 181 or to the transfer belt 189.

The identifying sensor 137 is composed of a combination of a photosensor 235 comprising a light-emitting element 221 and a light-receiving element 223 opposite to each other at the upper and the lower side arranged on right and left outside of the rotation roller 161 of the taking-out device 135, and a magnetic sensor 237 arranged between the rotation rollers 161.

The photosensor 235 works to detect the reading of pattern of bills W at each position, the pattern recognition, and the transmitted pattern and the like by the encoder 239, and the detection signal thereof is input to the control section 241.

The magnetic sensor 237 detects the magnetism by unit of each bill contained in the ink by pressing the bill W from the upper side by a magnetic sensor pad 243 formed like a tongue, and the detection signal thereof is input to the control section 141. In addition, the magnetic sensor pad 243 is formed by cutting the case floor portion 240 of the control section case 238 where the control section 241 and the display section 117 are provided.

The encoder 239 works to detect the feed ratio of the rotation roller 161 by transferring the rotation number from the roller shaft 165 of the rotation roller 161 to the rotation plate 247 by the gear transfer by means of the gear 245 and counting the rotation number thereof by the number of transmitting holes 249 provided at even intervals on the rotation plate 247 by a photo element 251, and the detection signal thereof is input to the control section 241. In addition, the position of the encoder 239 to be attached may be at any position so long as it is between the separation/feeding-out device 133 and the taking-out device 135.

The control section 241 has information such as, for example, figures and magnetic quantity by unit of each bill preliminarily input thereto, and carries out the operation based on the signals from each sensor to output the signal showing the number of sheets by unit of each bill and the total amount to the display section 117, while it works to stop the operation of the driving motor 167 when a forged bill is detected.

Figure 19:
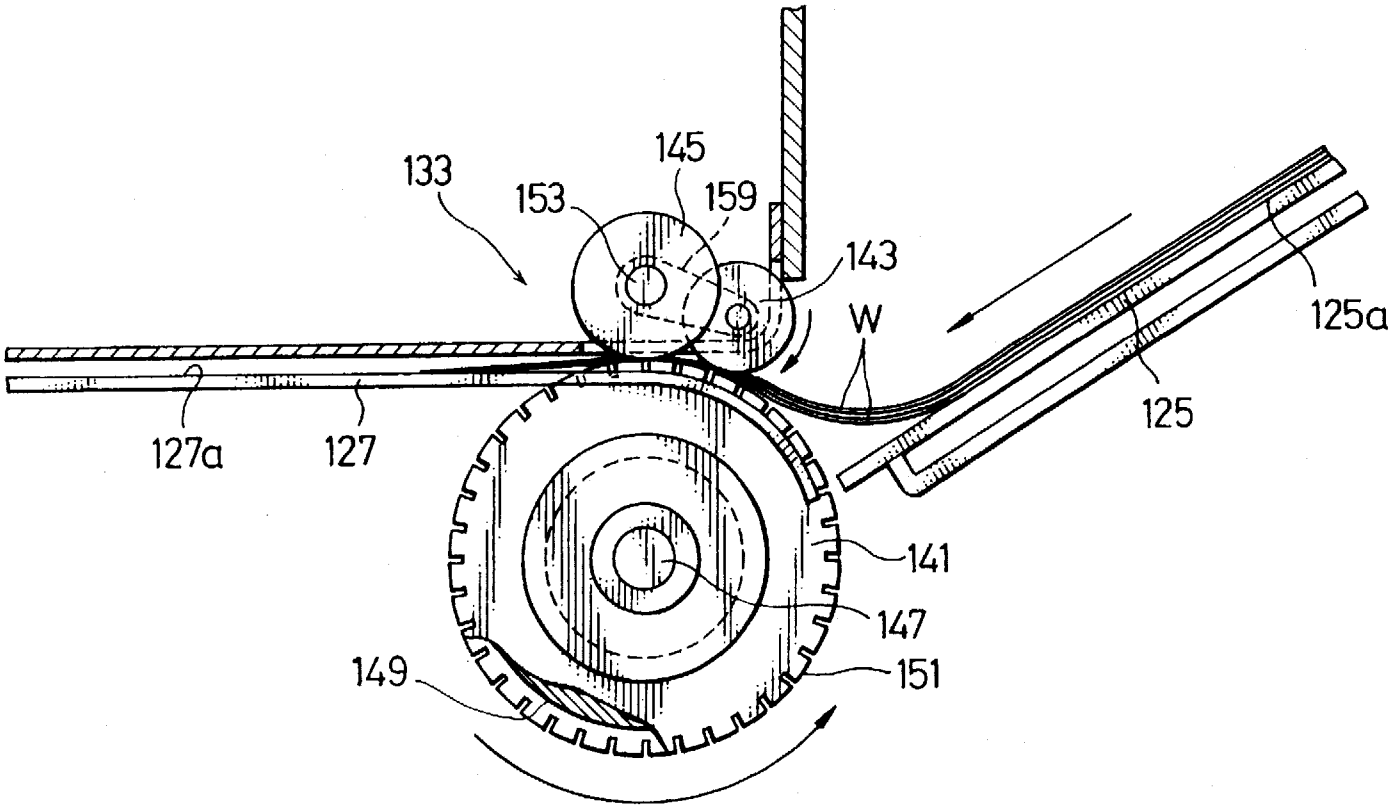
FIG. 19 is an enlarged view illustrating the separation/feeding-out device.

According to the bill counter 115 thus constituted, when a bundle of bills including 1,000-yen bills, 5,000-yen bills and 10,000-yen bills at random is inserted to the setting port 121 and the start key 120 is pushed, the bills are fed out by the weight of itself or by the operation of the feeding roller 131 toward the separation/feeding-out device 133. At the separation/feeding-out device 133, as shown in FIG. 19, the lowest bill W is separated alone, and the bills other than the first sheet are held by the holding roller 145 to stand by, at the same time the first bill W is fed out by the frictional force of the geared roller face 151 and sent out sequentially toward outside from the taking-out port 123 by the rotation roller 161 of the taking-out device 135. At this time, since the speed of the taking-out device 135 to take out the bill is faster than that of separation/feeding-out device 133 to feed out the bill, the bill can be taken out securely one by one to the bill-receiving portion 114, as well as whether the bill is true or forged, or the kind and the number of sheets of each bill are identified by the identifying sensor 137 and the information thereof is input to the control section 241. In this case, the stable detection is made possible by the encoder 239 to obtain the correct identifying position of the identifying sensor 137, while the control section 241 outputs a signal based on the signal from the identifying sensor 241. Thereby, as shown in FIG. 17, the number of 1,000-yen bills, 5,000-yen bills and 10,000-yen bills and the total amount are displayed at the display section 117.

Furthermore, when a forged bill is detected by the identifying sensor 137, the operation of the driving motor 167 is stopped. As a result, the function as a device for finding forged bills can be obtained.

Figure 17:
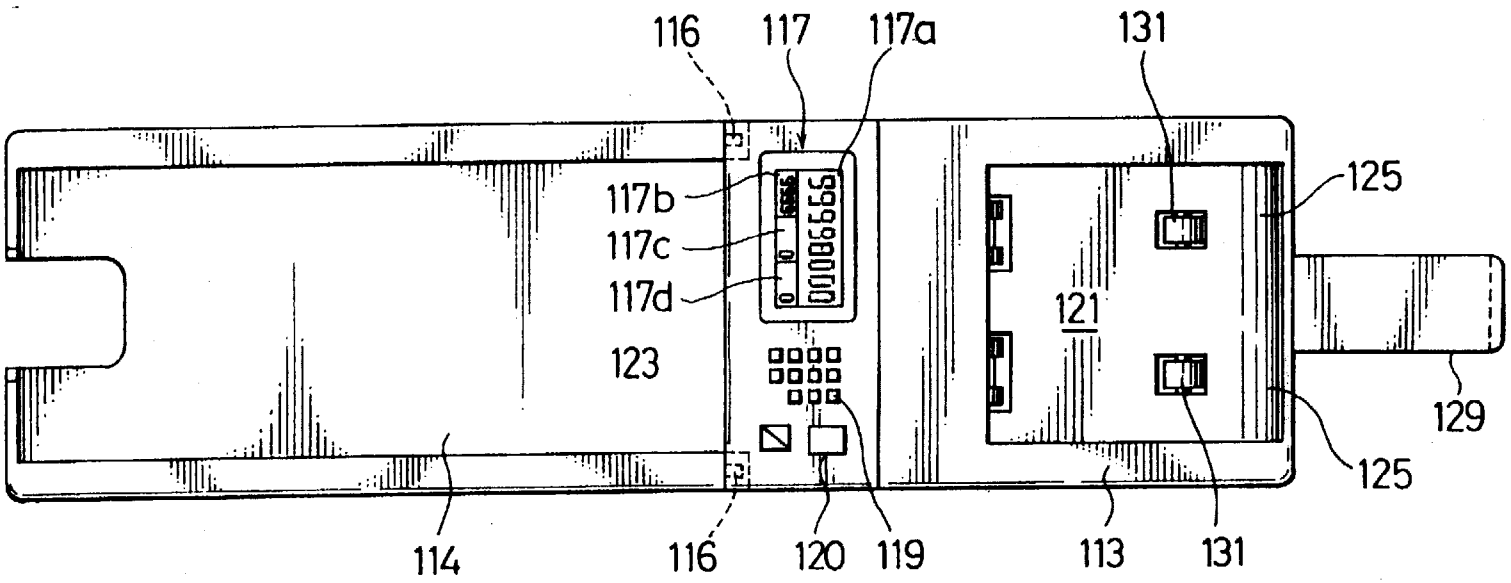
FIG. 17 is a plan view of the whole bill counter set to the bill-receiving portion.
Figure 18:
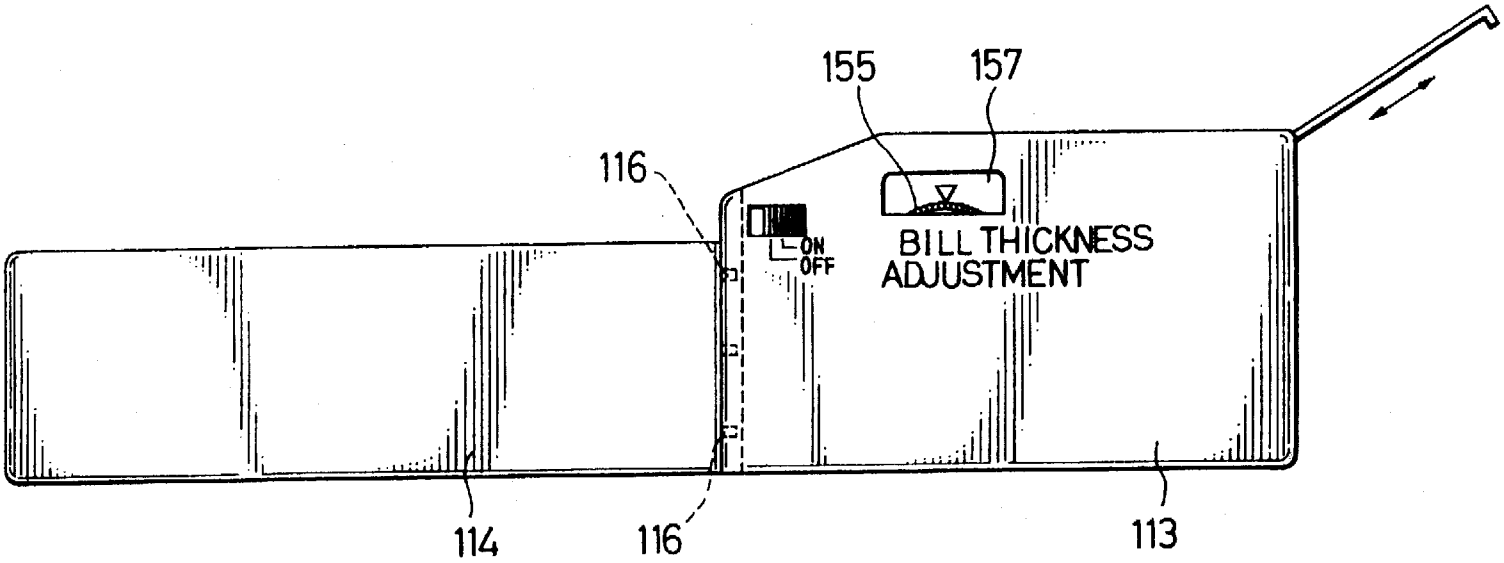
FIG. 18 is a sectional view of FIG. 17.

Next, as an alternative usage, when it is desired to take out the necessary number of sheets from the bundle of, for example, 10,000-yen bills, set a bundle of 10,000-yen bills at the setting port 121 and push the setting key 119 to set the number of sheets to the total-amount display section 117a, as shown in FIG. 17. Then, by operating the start key 120, bills are fed out sequentially from the taking-out port 123 and when the identifying sensor 137 detects the number of sheets set in advance, the detection signal is input to the control section 241. The control section 241 stops the operation of the driving motor 167 based on the detection signal. Thereby, for example, the number of sheets is displayed on the display section 117*b* for the number of sheets of 10,000-yen bills, while the necessary number of sheets of the bill W can be taken out from the taking-out port 123 to the bill-receiving section 114.

As described above, according to the bill counter of the present invention, the following effects can be attained:

(1) Since the bill counter can be carried freely, there is no restriction regarding the place to be used.

(2) When 1,000-yen bills, 5,000-yen bills and 10,000-yen bills are set together, the number of sheets per each bill and the total amount can be displayed, as well as the function as a device for finding forged bills can be obtained.

(3) While the bill counter is compact, it can take out the bill one by one securely.

(4) Correct identification of the bill by the identifying sensor can be performed by the encoder.

Although some preferred embodiments of the invention have been described above by way of example only, it will be understood by those skilled in the field that modifications may be made to the disclosed embodiments without departing from the scope of the invention, which is defined by the appended claims.

We claim:

1. A bill counter which comprises:

a case body formed to be a size which can be held by a single hand;

a display section provided on the surface of the case body;

an insertion port provided on one side of the case body which is capable of being expanded/contracted;

a taking-out port provided on the other side of the case body;

a first feeding-out device which ms provided on the insertion port side within the case body and feeds out bills in a bundle inserted to the insertion port by a few sheets;

a second feeding-out device which is provided on the taking-out port side within the case body and feeds out bills one by one fed out by the first feeding-out device;

a driving section which drives simultaneously the first and the second feeding-out devices;

an identifying sensor which identifies bills fed out by said second feeding-out device; and a control section which outputs a signal displaying the number of sheets by unit of each bill and the total amount at least to said display section based on the signal from said identifying sensor and a signal which stops the operation of the driving section when a forged bill is detected.

2. A bill counter according to claim 1, wherein the first feeding-out device comprises a rotating body of a roller type or a belt type whose outer peripheral face is formed on the friction face, and a pressing body which always presses the bundle of bills inserted to the insertion port against the rotating body.

3. A bill counter according to claim 1, wherein the second feeding-out device comprises a pair of rotation rollers on right and left whose outer peripheral face is formed on the friction face, and a control member which is capable of going forward/backward, holds the tip end of the bills other than the first bill overlapping with each other against the rotation roller and controls its feeding.

4. A bill counter according to claim 1, wherein the identifying sensor comprises a combination of a photosensor and a magnetic sensor.

5. A bill counter according to claim 1, wherein the position to attach an encoder which detects the position to identify the bills by the identifying sensor is set between the separation/feeding-out device and the taking-out device.

6. A bill counter which comprises:

a display section provided on the surface of the case body formed to be a size which can be carried;

a setting port which is provided on one side of the case body to set bills;

a taking-out port provided on the other side of the case body;

a separation/feeding-out device which separates and feeds out the bills supplied from the setting port one by one;

a taking-out device which takes out the bills from the taking-out port to the outside;

a driving section which drives simultaneously the separation/feeding-out device and the taking-out device;

an identifying sensor which identifies bills fed out by said separation/feeding-out device; and a control section which outputs a signal displaying the number of sheets by unit of each bill and the total amount at least to said display section based on the signal from the identifying sensor, and a signal which stops the operation of the driving section when a forged bill is detected;

wherein the speed for taking out the bills toward outside by said taking-out device is made faster than the feeding speed of the bills which are fed out by said separation/feeding-out device.

7. A bill counter according to claim 6, wherein the separation/feeding-out device comprises:

first rollers which are pivotally attached rotatably on right and left of a roller shaft and are composed of geared double rubber rollers having a peripheral groove in the central portion and of geared roller faces with a shape projecting partly from a notch window of a guide plate;

holding rollers which are firmly adhered to an eccentric shaft and faces into the peripheral grooves of the first right and left rollers so as to hold the surface of a bill W down into the peripheral groove; and second rollers which are energized downward so as to be brought into contact with the geared roller faces inside of the first rollers, as well as being supported horizontally movably by a supporting arm extended from the eccentric shaft of the holding rollers.

8. A bill counter according to claim 7, further comprising:

a rotation handle which is provided at the shaft end of the eccentric shaft from an adjusting window toward right or left to move the holding rollers upward or downward by the volume of eccentricity of the eccentric shaft.

9. A bill counter according to claim 6, wherein the identifying sensor comprises a combination of a photosensor and a magnetic sensor.

10. A bill counter according to claim 6, wherein the position to attach an encoder which detects the position to identify the bills by the identifying sensor is set between the separation/feeding-out device and the taking-out device.

* * * * *